US006935702B2

(12) United States Patent
Okazaki et al.

(10) Patent No.: US 6,935,702 B2
(45) Date of Patent: Aug. 30, 2005

(54) CRUSHING APPARATUS ELECTRODE AND CRUSHING APPARATUS

(75) Inventors: Toru Okazaki, Osaka (JP); Koji Urano, Tokyo (JP)

(73) Assignees: Kumagai Gumi Co., Ltd., Fukui (JP); Okumura Engineering Corporation, Osaka (JP)

( * ) Notice: Subject to any disclaimer, the term of this patent is extended or adjusted under 35 U.S.C. 154(b) by 195 days.

(21) Appl. No.: 10/333,076

(22) PCT Filed: Apr. 4, 2002

(86) PCT No.: PCT/JP02/03387

§ 371 (c)(1),
(2), (4) Date: Jan. 16, 2003

(87) PCT Pub. No.: WO02/083312

PCT Pub. Date: Oct. 24, 2002

(65) Prior Publication Data

US 2004/0026548 A1 Feb. 12, 2004

(30) Foreign Application Priority Data

Apr. 6, 2001 (JP) ..... 2001-108388

(51) Int. Cl.[7] ..... E21C 37/18
(52) U.S. Cl. ..... 299/14; 299/13
(58) Field of Search ..... 343/790–792; 299/14, 16, 13

(56) References Cited

U.S. PATENT DOCUMENTS

| | | | | | |
|---|---|---|---|---|---|
| 3,713,166 | A | * | 1/1973 | Munson et al. | 343/792 |
| 4,115,783 | A | * | 9/1978 | Reggia | 343/792 |
| 4,653,697 | A | * | 3/1987 | Codina | 241/301 |
| 5,106,164 | A | | 4/1992 | Kitzinger et al. | |
| 5,425,570 | A | * | 6/1995 | Wilkinson | 299/14 |

FOREIGN PATENT DOCUMENTS

| | | | |
|---|---|---|---|
| EP | 777102 | A2 | 6/1997 |
| EP | 1033551 | A2 | 9/2000 |
| JP | 36-10730 | | 7/1961 |
| JP | 63-221857 | A | 9/1988 |
| JP | 4-222794 | | 8/1992 |
| JP | 2000-248873 | | 9/2000 |

* cited by examiner

*Primary Examiner*—John Kreck
(74) *Attorney, Agent, or Firm*—McDermott Will & Emery LLP

(57) ABSTRACT

An electrode for a crusher and a crusher capable of increasing energy utilized for crushing are obtained. The electrode 1 for a crusher comprises a central conductor (12, 17) extending along a central axis and having an outer peripheral surface, an insulating member (13, 18) arranged on the outer peripheral surface of the central conductor (12, 17) and a peripheral conductor (15) arranged to enclose the insulating member (13, 18). The peripheral conductor (15) includes a first conductor (14*a*) and a second conductor (14*b*) arranged at a space from the first conductor (14*a*) in the extensional direction of the central axis.

15 Claims, 12 Drawing Sheets

CRUSHING APPARATUS ELECTRODE AND CRUSHING APPARATUS

TECHNICAL FIELD

The present invention relates to a crusher for breaking rock or the like and an electrode for the crusher, and more specifically, it relates to a crusher and an electrode for a crusher capable of efficiently breaking rock or the like.

BACKGROUND ART

For example, Japanese Patent Laying-Open No. 4-222794 discloses a conventional crushing method for breaking rock or the like. FIG. 19 is a model diagram showing a conventional crusher. FIG. 20 is a model diagram showing the basic structure of the crusher shown in FIG. 19, and FIG. 21 is a partially enlarged model diagram showing the forward end of an electrode shown in FIG. 20. The structure and the operation of the crusher for carrying out the crushing method disclosed in the aforementioned Japanese Patent Laying-Open No. 4-222794 are described with reference to FIGS. 19 to 21.

First, the structure of the conventional crusher is briefly described with reference to FIGS. 19 to 21. A pulse power source 106 consists of a circuit including a capacitor 108, a switch 107 and the like. A power source 109 is connected to the pulse power source 106. The circuit of the pulse power source 106, a casing including this circuit and a car body carrying the crusher are grounded.

A coaxial electrode 101 serving as a breakdown electrode for breaking rock or the like is connected to the pulse power source 106 through a coaxial cable 105. A center electrode 112 and a peripheral electrode 115 located on the outer periphery of the center electrode 112 through an insulator 113 are arranged on the forward end of the coaxial electrode 101. One of the center electrode 112 and the peripheral electrode 115 is grounded, while charges stored in the capacitor 108 are guided to the other one when the switch 107 of the pulse power source 106 is closed.

The conventional crushing method is now described. A preliminary hole 110 is previously formed in the rock or the like to be broken with a drill or the like. An electrolyte such as water 111 is injected into the preliminary hole 110. The coaxial electrode 101 is inserted into the preliminary hole 110.

The power source 109 generates charges, which in turn are stored in the capacitor 108. A unilateral pole of the capacitor 108 is grounded.

The switch 107 is closed after the capacitor 108 sufficiently stores charges, thereby supplying the charges to the coaxial electrode 101 through the coaxial cable 105. Potential difference takes place between the center electrode 112 and the peripheral electrode 115 on the forward end of the coaxial electrode 101, thereby causing a discharge. At this time, the electrolyte is converted to plasma by discharge energy around the forward end of the coaxial electrode 101, thereby generating a pressure wave. This pressure wave breaks the rock or the like around the coaxial electrode 101.

The aforementioned Japanese Patent Laying-Open No. 4-222794 states that electric energy is supplied to the coaxial electrode 101 in a ratio of at least 100 MW per microsecond when crushing rock or the like until power having a peak value of at least 3 GW is obtained across two electrodes (the center electrode 112 and the peripheral electrode 115) of the coaxial electrode 101 dipped in the electrolyte in a confined region of the substance to be crushed.

The aforementioned conventional crusher has the following problem: The electrolyte is in a plasma state in a region where an arc is formed by the discharge between the center electrode 112 and the peripheral electrode 115, and the temperature of this region remarkably varies with the value of the current supplied to the coaxial electrode 101. In other words, the temperature of the region where the arc is formed is increased as the current value is increased. On the other hand, it is known that discharge resistance is reduced as the temperature of the region where the arc is formed is increased. The energy consumed by the discharge of the coaxial electrode 101 is proportionate to a value obtained by multiplying the square of the value of the current supplied to the coaxial electrode 101 by the discharge resistance.

Also when the value of the current supplied to the coaxial electrode 101 is increased for increasing the energy (energy utilized for crushing) consumed by the discharge of the coaxial electrode 101, therefore, the discharge resistance is reduced as the current value is increased. Thus, it is difficult to sufficiently increase the energy consumed by the discharge of the coaxial electrode 101 by simply increasing the aforementioned current value. In the conventional crusher, therefore, it is difficult to efficiently perform crushing by increasing the energy utilized for crushing.

The present invention has been proposed in order to solve the aforementioned problem, and an object of the present invention is to provide an electrode for a crusher and a crusher capable of increasing energy utilized for crushing.

DISCLOSURE OF THE INVENTION

An electrode for a crusher according to an aspect of the present invention comprises a central conductor extending along a central axis and having an outer peripheral surface, an insulating member arranged on the outer peripheral surface of the central conductor, and a peripheral conductor arranged to enclose the insulating member. The peripheral conductor includes a first conductor and a second conductor arranged at a space from the first conductor in the extensional direction of the central axis.

According to this structure, a first discharge is caused between a portion of the central conductor located on an end of the electrode for a crusher and either the first or second conductor arranged closer to this end when a current is supplied to the electrode for a crusher and this current flows between the central conductor serving as a center electrode and the peripheral conductor serving as a peripheral electrode. A second discharge is caused also between the first conductor and the second conductor. In other words, discharges are caused on at least two portions in the electrode according to the present invention, while a discharge is caused in only a single portion of an end in the conventional electrode. The number of portions causing discharges is so increased that discharge resistance can be increased beyond that in the prior art in response to the number of discharge portions when setting the current to a constant value. Hence, the energy utilized for crushing can be reliably increased beyond that in the prior art. Therefore, the ability (crushability) of the crusher can be increased. In general, the discharge resistance is small as compared with the resistance of the overall circuit and increase of the discharge resistance on several portions is small as compared with the resistance of the overall circuit, and hence crushing force can be increased without changing the size of a power source.

In the electrode for a crusher according to the aforementioned aspect, it is preferable that the central conductor includes an end causing a discharge, and the first conductor is arranged closer to the end in the extensional direction of the central axis and includes both ends in the extensional direction of the central axis and a region held between these ends. Both ends of the first conductor preferably have portions having relatively small diameters, and the region held between both ends of the first conductor preferably includes a portion having a relatively large diameter.

In this case, it follows that a first discharge is caused between the central conductor located on the end and the first conductor, and a second discharge is caused between the first conductor and the second conductor. In other words, the first and second discharges are caused to hold the first conductor therebetween. When the diameter of the region held between both ends of the first conductor is relatively increased, the region causing the first discharge and the region causing the second discharge can be isolated from each other by the portion having the relatively large diameter. Consequently, the first discharge and the second discharge can be prevented from interfering with each other. Thus, the number of discharge portions can be prevented from reduction caused by integration of arcs resulting from the first and second discharges, whereby the discharge resistance can be prevented from reduction. Therefore, the ability of the crusher can be reliably improved.

In the electrode for a crusher according to the aforementioned aspect, a projection is preferably formed on at least either one of the first and second conductors.

In this case, projections are so formed on the first and second conductors that charges can be concentrated to the projections when a current is supplied to the electrode. Thus, discharges can be preferentially caused on the portions formed with the projections. Therefore, the positions of the regions causing the discharges can be arbitrarily changed by changing the positions of the projections.

In the electrode for a crusher according to the aforementioned aspect, the projection may include a first projection formed on either one of the first and second conductors and a second projection formed on a position different from the position of the first projection in the circumferential direction of the central axis on at least either one of the first and second conductors.

When the first discharge and the second discharge are caused on substantially identical positions in the circumferential direction of the central axis, this may lead to such a phenomenon that the arc in the first discharge and the arc in the second discharge are connected (integrated) with each other. When the arcs of the first and second discharges are integrated with each other, this results in a state similar to that where only a single discharge is caused in the electrode for a crusher and the energy utilized for crushing is reduced.

According to the inventive electrode for a crusher, however, the first projection and the second projection are formed on different positions in the circumferential direction of the central axis, whereby a discharge caused on the portion formed with the first projection and another discharge caused on the portion formed with the second projection can take place on different positions in the circumferential direction of the central axis. Therefore, when the first projection is formed on a region facing the end of the electrode for a crusher in the first or second conductor located closer to the end of the electrode for a crusher and the second projection is formed on a region facing the first conductor in the second conductor, for example, the first discharge caused on the end of the electrode for a crusher corresponds to the aforementioned discharge and the second discharge caused between the first conductor and the second conductor corresponds to the aforementioned other discharge. Consequently, the first discharge and the second discharge can be caused on different positions in the circumferential direction of the central axis respectively. As a result, the arc in the first discharge and the arc in the second discharge can be prevented from connection (integration). Therefore, the energy utilized for crushing can be prevented from reduction resulting from connection of the arcs in the first and second discharges.

The inventor has made experiments and studies as to discharge phenomena in the electrode for a crusher, to obtain the following recognition: The electrode for a crusher according to the present invention causes a plurality of discharges in a single electrode for a crusher thereby increasing the energy utilized for crushing, and hence it is necessary to independently cause a plurality of discharges. Therefore, the inventor has observed discharge phenomena in the electrode for a crusher in detail, and studied conditions for independently stably causing a plurality of discharges. According to experiments by the inventor, an arc resulting from a discharge was relatively small immediately after starting the discharge when the discharge was caused between the first and second conductors, for example, in the electrode for a crusher, while the size of this arc grew with time to some extent in the central axis direction. When the size of the arc was increased to some extent, the size of the arc thereafter remained substantially unchanged. Ends of the arc having such a stable size reached positions penetrating onto the first and second conductors by a length of about 10 mm from ends of the first and second conductors in a direction along the central axis. The length (arc extension length) of the arc extending from the ends of the first and second conductors onto the first and second conductors remained substantially unchanged also when the voltage of the power source employed for crushing or the shape of or the material for the electrode for a crusher was changed, if the lengths of the first and second conductors along the central axis direction were sufficiently increased.

When the lengths of the first and second conductors in the central axis direction were set smaller than 10 mm, on the other hand, the arc extension length was limited to the lengths of the first and second conductors at the maximum, and the arc could not sufficiently grow. In such a state, energy (energy utilized for crushing) consumed by the discharge was smaller than that in the case where the arc sufficiently grew.

If the lengths of the first and second conductors in the central axis direction are smaller than 10 mm, two arcs are readily connected with each other when the arc resulting from the first discharge and the arc resulting from the second discharge are formed on positions close to each other in the circumferential direction of the central axis. Consequently, the energy utilized for crushing is disadvantageously reduced also in this case.

On the basis of such recognition of the inventor, the length of at least either one of the first and second conductors is preferably at least 10 mm in the extensional direction of the central axis in the electrode for a crusher according to the aforementioned aspect.

In this case, the arcs of the discharges can be sufficiently enlarged in the direction along the central axis, whereby the energy utilized for crushing can be sufficiently increased.

In the electrode for a crusher according to the aforementioned aspect, the length of at least either one of the first and second conductors is more preferably at least 20 mm in the extensional direction of the central axis.

If the length of the first conductor in the extensional direction of the central axis is set to at least 20 mm in this case, for example, the two arcs can be sufficiently grown in independent states also when the two arcs generated on both ends of the first conductor are formed on positions close to each other in the circumferential direction of the central axis. In other words, integration of the arcs of the first and second discharges can be reliably prevented, while the energy utilized for crushing can be increased by sufficiently growing the arcs.

In the electrode for a crusher according to the aforementioned aspect, the peripheral conductor may include at least one additional conductor arranged at a space from the second conductor in the extensional direction of the central axis.

In this case, a third discharge can be caused between the second conductor and the additional conductor. When the additional conductor includes a plurality of conductors formed at a space, fourth and fifth discharges can be further caused. Consequently, the discharge resistance can be further improved, whereby the energy utilized for crushing can be further increased.

In the electrode for a crusher according to the aforementioned aspect, a projection may be formed on at least one conductor selected from a group consisting of the first conductor, the second conductor and the additional conductor.

In this case, charges can be concentrated to the projection when a current is supplied to the electrode. Therefore, a discharge can be preferentially caused on the portion formed with the projection. Thus, the position of the region causing the discharge can be arbitrarily changed by changing the position of the projection.

In the electrode for a crusher according to the aforementioned aspect, the projection may project in a direction substantially parallel to the extensional direction of the central axis.

In this case, the distance between the first and second conductors in the extensional direction of the central axis or the distance between the central conductor and either one of the first and second conductors in the extensional direction of the central axis can be locally reduced. Therefore, a discharge can be preferentially caused on the portion formed with the projection. Thus, the position of the region causing the discharge can be arbitrarily changed by changing the position of the projection.

In the electrode for a crusher according to the aforementioned aspect, the projection may project in the radial direction of the central axis.

In this case, the shape of the first or second conductor in the radial direction of the central axis can be rendered ununiform due to formation of the projection, whereby the region for causing the discharge can be arbitrarily changed by changing the position of the projection.

In the electrode for a crusher according to the aforementioned aspect, the projection may include a first projection formed on one conductor selected from the group consisting of the first conductor, the second conductor and the additional conductor and a second projection formed on a position different from the position of the first projection in the circumferential direction of the central axis in at least one conductor selected from the group consisting of the first conductor, the second conductor and the additional conductor.

In this case, the first projection and the second projection are formed on different positions in the circumferential direction of the central axis, whereby a discharge caused on the portion formed with the first projection and another discharge caused on the portion formed with the second projection can be caused on different positions in the circumferential direction of the central axis. Therefore, an arc in the discharge and an arc in the other discharge can be prevented from connection (integration). Consequently, the energy utilized for crushing can be prevented from reduction resulting from connection of the arc in the discharge and the arc in the other discharge.

In the electrode for a crusher according to the aforementioned aspect, the length of at least one conductor selected from a group consisting of the first conductor, the second conductor and the additional conductor is preferably at least 10 mm in the extensional direction of the central axis.

In this case, the arc of the discharge can be sufficiently enlarged in the direction along the central axis in any of the first conductor, the second conductor and the additional conductor having the length of at least 10 mm. Thus, the energy utilized for crushing can be sufficiently increased.

In the electrode for a crusher according to the aforementioned aspect, the length of at least one conductor selected from the group consisting of the first conductor, the second conductor and the additional conductor is more preferably at least 20 mm.

If the length of the second conductor in the extensional direction of the central axis is set to at least 20 mm in this case, for example, two arcs can be sufficiently grown in independent states in the second conductor with no reduction of resistance resulting from integration also when the two arcs caused on both ends of the second conductor are formed on positions close to each other in the circumferential direction of the central axis. In other words, two arcs caused on both ends of the second conductor or the like can be reliably prevented from integration, while the energy utilized for crushing can be increased by sufficiently growing the arcs.

In the electrode for a crusher according to the aforementioned aspect, the central conductor may include a stranded conductor, and the insulating member may contain a flexible material.

In an operation of crushing rock or the like, an impact may also transversely be applied to the electrode. When the electrode for a crusher has a certain degree of flexibility due to the aforementioned structure in this case, the transverse impact can be absorbed by deformation of the electrode, whereby such an accident that the electrode is broken by the impact can be prevented. Therefore, the life of the electrode can be increased.

A crusher according to another aspect of the present invention comprises the electrode for a crusher according to the aforementioned aspect.

In this case, a crusher having high crushability can be readily obtained.

BEST MODES FOR CARRYING OUT THE INVENTION

Figure 1:
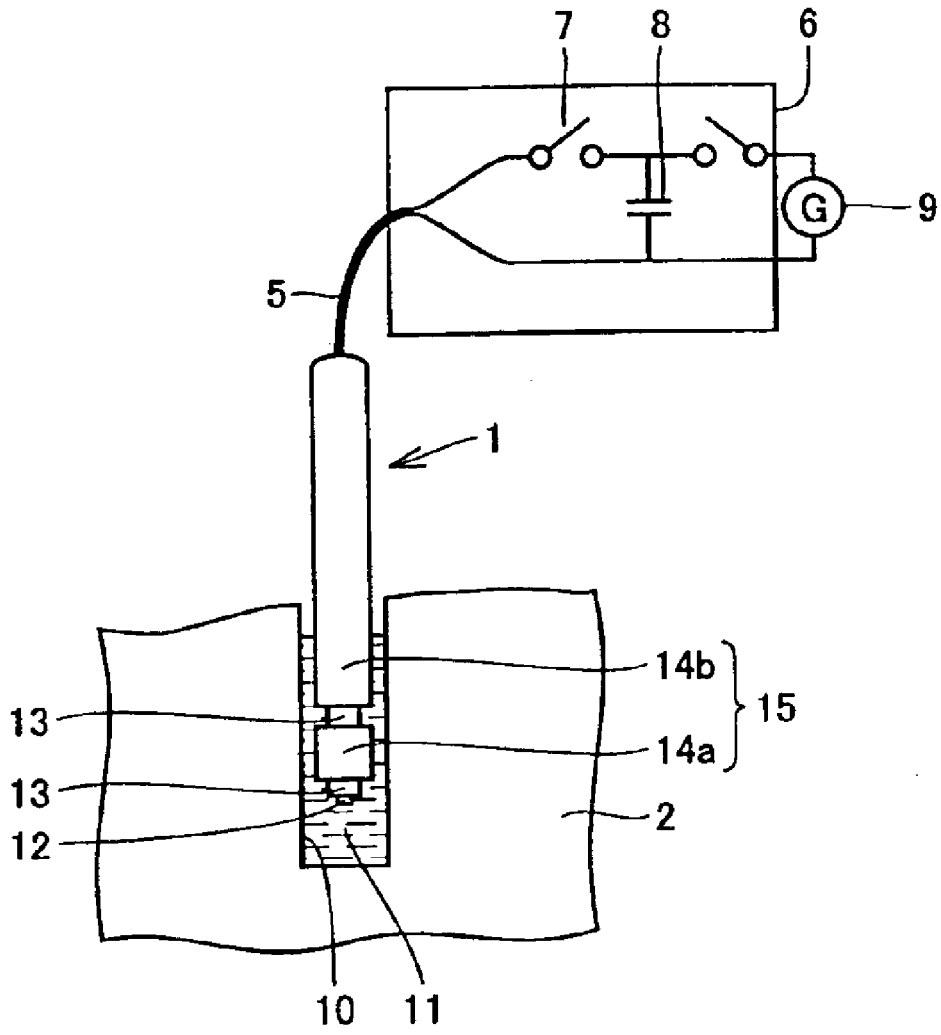
FIG. 1 is a model diagram for illustrating the device structure of an electrode for a crusher and a crusher employing the electrode for a crusher according to a first embodiment of the present invention.
Figure 2:
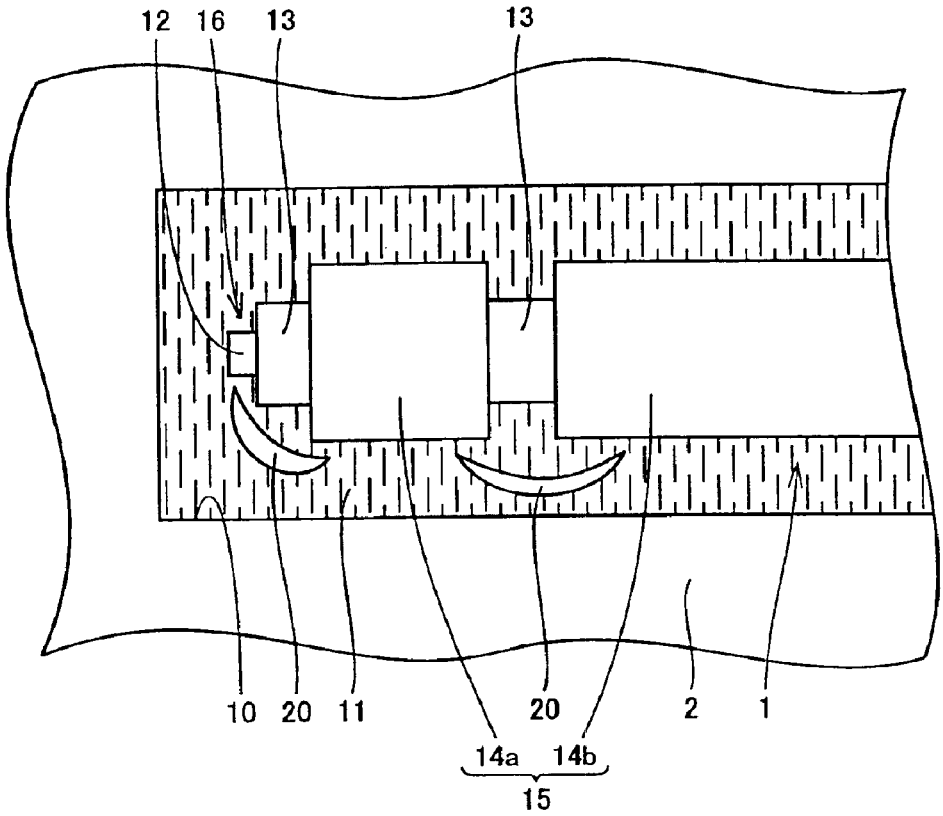
FIG. 2 is a partially enlarged model diagram showing the forward end of the electrode for a crusher shown in FIG. 1.
Figure 3:
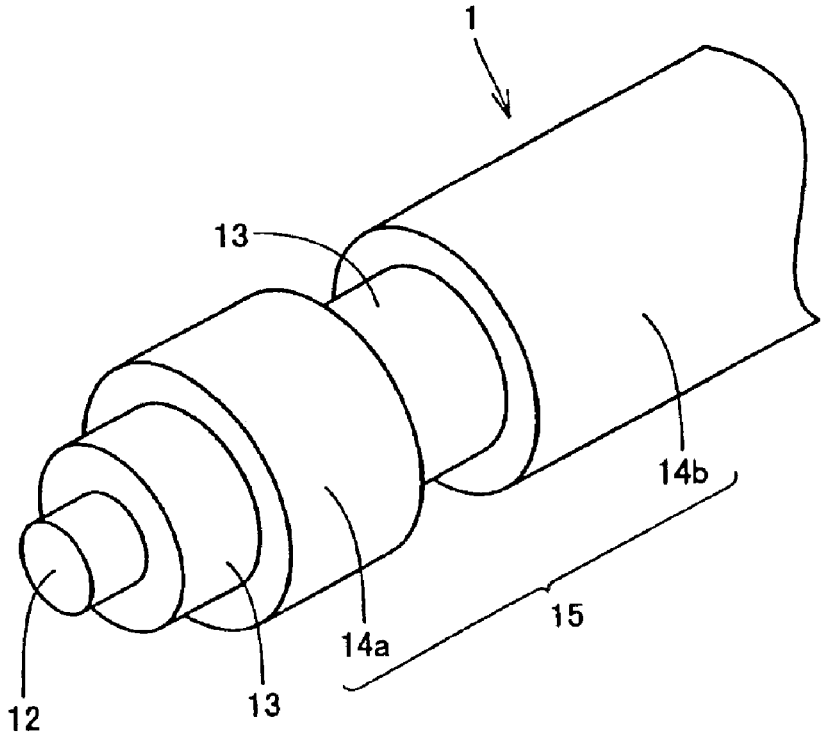
FIG. 3 is an enlarged schematic perspective view showing the forward end of the electrode for a crusher shown in FIG. 1.
Figure 4:
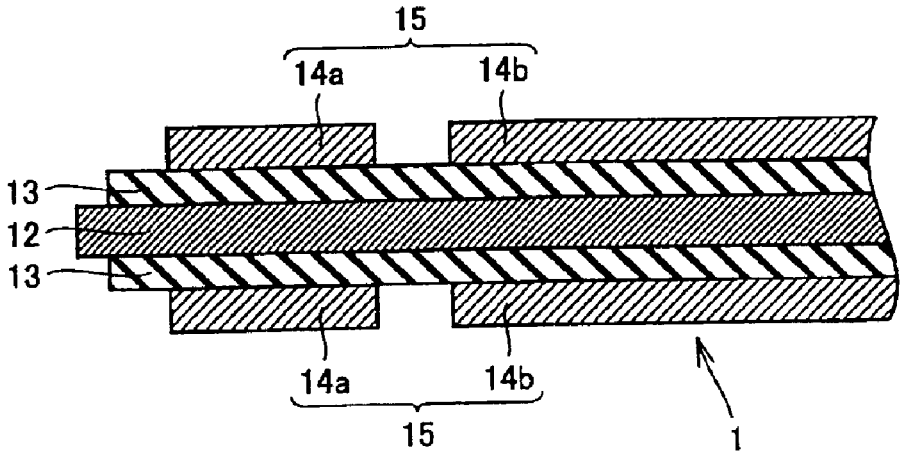
FIG. 4 is a schematic sectional view of the electrode for a crusher shown in FIG. 2.

Embodiments of the present invention are now described with reference to the drawings. In the following drawings, identical or corresponding parts are denoted by the same reference numerals, and redundant description is not repeated.

(First Embodiment)

An electrode for a crusher and a crusher according to a first embodiment of the present invention are described with reference to FIGS. 1 to 4.

Referring to FIGS. 1 to 4, the crusher according to the present invention comprises a coaxial electrode 1, a pulse power source 6, a power source 9 and a coaxial cable 5. The pulse power source 6 consists of a circuit including a capacitor 8, a switch 7 and the like. The power source 9 is connected to the pulse power source 6. The circuit of the pulse power source 6 is grounded. The coaxial electrode 1 which is the electrode for a crusher is connected to the pulse power source 6 through the coaxial cable 5. The coaxial electrode 1 comprises a center electrode 12 serving as a central conductor extending along a central axis, an insulator 13 serving as an insulating member arranged on the outer peripheral surface of this center electrode 12, and a peripheral electrode 15 serving as a peripheral conductor arranged on the outer peripheral surface of this insulator 13. The coaxial electrode 1 is inserted in a preliminary hole 10 formed in a crushed object 2 such as rock. Water 11 serving as en electrolyte is arranged in the preliminary hole 10. An end of the center electrode 12 projects from the forward end 16 of the coaxial electrode 1. The peripheral electrode 15 includes a peripheral electrode part 14*a* serving as a first conductor located closer to the forward end 16 and a peripheral electrode part 14*b* serving as a second conductor arranged at a space from this peripheral electrode part 14*a* in the extensional direction of the central axis.

When the switch 7 of the pulse power source 6 is closed and charges stored in the capacitor 8 are introduced into the coaxial electrode 1, a first discharge is caused between the end of the center electrode 12 and the peripheral electrode part 14*a*, to form an arc 20. A discharge is caused also between the peripheral electrode part 14*a* and the peripheral electrode part 14*b*, to form another arc 20.

Thus, two arcs 20 can be formed as described above when a current is supplied to the coaxial electrode 1 serving as the electrode for a crusher and this current flows between the center electrode 12 and the peripheral electrode 15. In other words, discharges are caused at least on two portions in the coaxial electrode 1 according to the present invention while a discharge is caused only on one portion of an end in the conventional coaxial electrode. The number of portions causing discharges is so increased that discharge resistance can be increased beyond that in the prior art when setting the current to a constant value. As already described, the energy consumed by discharges is proportionate to the value obtained by multiplying the square of the value of the current supplied to the coaxial electrode 1 by the discharge resistance, whereby the energy (i.e., the energy utilized for crushing) consumed by the discharges can be reliably increased beyond that in the prior art. Therefore, the coaxial electrode 1 serving as the electrode for a crusher and a crusher capable of increasing crushability can be implemented.

A first modification of the electrode for a crusher shown in FIGS. 1 to 4 is described with reference to FIG. 5.

Figure 5:
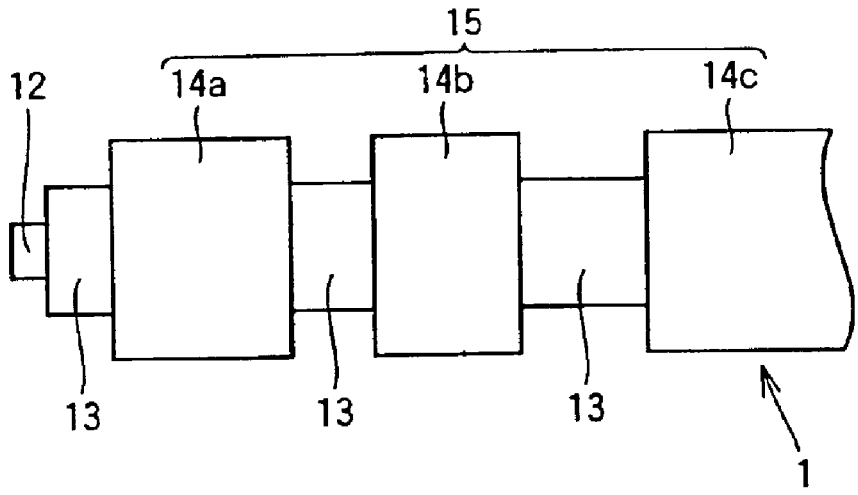
FIG. 5 is a partially enlarged model diagram showing a first modification of the electrode for a crusher shown in FIGS. 1 to 4.

Referring to FIG. 5, a coaxial electrode 1 which is the electrode for a crusher basically has a structure similar to that of the coaxial electrode shown in FIGS. 1 to 4. In the coaxial electrode shown in FIG. 5, however, a peripheral electrode 15 includes three peripheral electrode parts 14*a* to 14*c*. The peripheral electrode parts 14*a* to 14*c* are arranged at spaces from each other respectively. In this case, an effect similar to that of the coaxial electrode shown in FIGS. 1 to 4 can be attained while discharges can be caused on three portions, i.e., between an end of a center electrode 12 and the peripheral electrode part 14*a*, between the peripheral electrode part 14*a* and the peripheral electrode part 14*b* and between the peripheral electrode part 14*b* and the peripheral electrode part 14*c*. Thus, discharge resistance can be further improved, whereby energy emitted by discharges can be further increased. Consequently, the ability of the crusher can be further improved.

The number of the peripheral electrode parts may be further increased for increasing the number of portions causing discharges. In this case, the ability of the crusher is further improved.

A second modification of the electrode for a crusher shown in FIGS. 1 to 4 is described with reference to FIG. 6.

Figure 6:
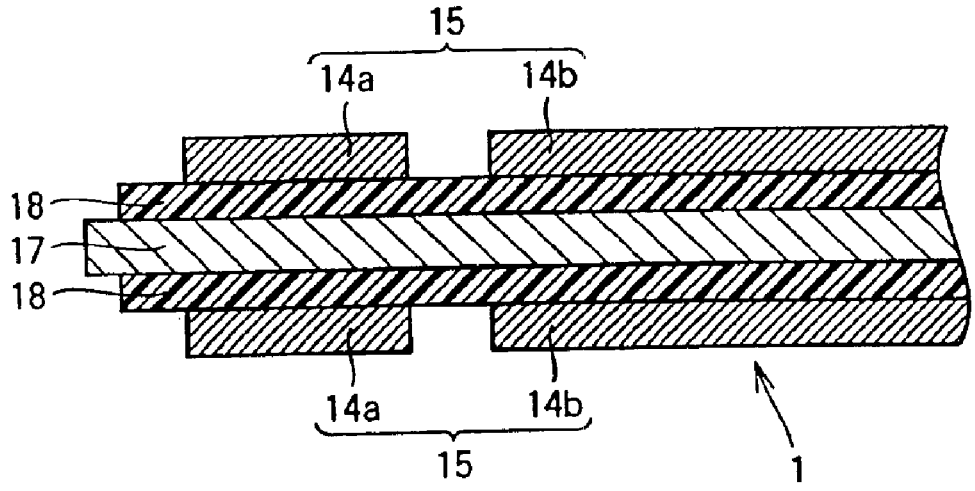
FIG. 6 is a schematic sectional view showing a second modification of the electrode for a crusher shown in FIGS. 1 to 4.

Referring to FIG. 6, a coaxial electrode 1 which is the electrode for a crusher basically has a structure similar to that of the coaxial electrode shown in FIGS. 1 to 4. However, a flexible stranded conductor 17 is employed as a center electrode. Further, a flexible insulator 18 of a rubber-based insulator or urethane is employed as an insulator.

When discharges are caused on a plurality of portions of the coaxial electrode 1 in the central axis direction as in the present invention in an operation of crushing rock or the like, an impact may also transversely be applied to the coaxial electrode 1. When employing the coaxial electrode 1 having a certain degree of flexibility as described above in this case, the transverse impact can be absorbed by deformation of the coaxial cable 1. Therefore, such an accident that the coaxial electrode 1 is broken by the impact can be prevented. Thus, the life of the coaxial electrode 1 can be increased.

(Second Embodiment)

An electrode for a crusher according to a second embodiment of the present invention is described with reference to FIG. 7.

Figure 7:
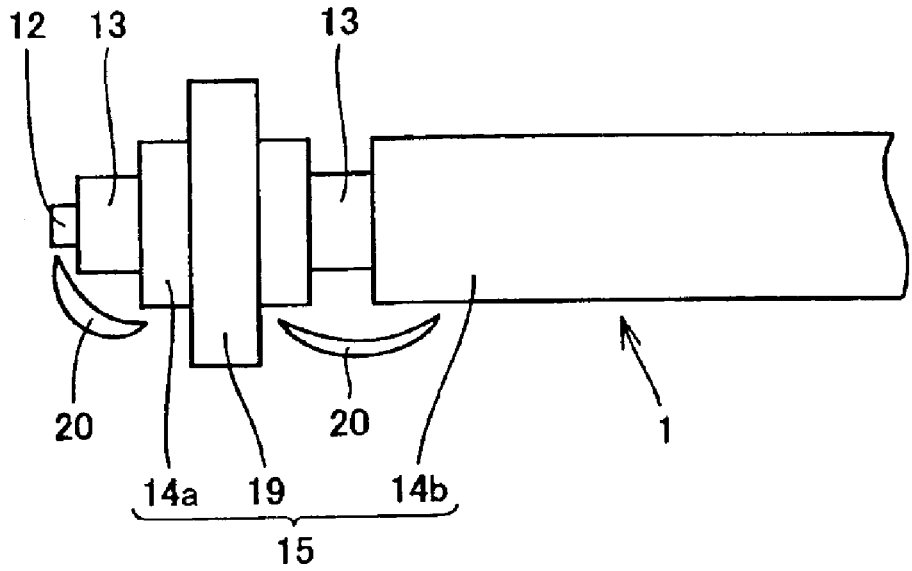
FIG. 7 is a partially enlarged model diagram showing an electrode for a crusher according to a second embodiment of the present invention.

Referring to FIG. 7, a coaxial electrode 1 serving as the electrode for a crusher basically has a structure similar to that of the coaxial electrode shown in FIGS. 1 to 4, while a diametrical convex portion 19 projecting in the outer peripheral direction and extending in the circumferential direction is formed on the central portion of a peripheral electrode part 14*a*.

In this case, it follows that a first discharge (arc 20) is caused between a portion of a center electrode 12 located on an end of the coaxial electrode 1 and the peripheral electrode part 14*a* serving as a first conductor while a second discharge (arc 20) is caused between the peripheral electrode part 14*a* and a peripheral electrode part 14*b* serving as a second conductor. In other words, two arcs 20 are generated to hold the peripheral electrode part 14*a* therebetween. The diametrical convex portion 19 is formed by relatively increasing the diameter of a region held between both ends in the extensional direction of a central axis in the peripheral electrode part 14*a*, so that the region causing the first discharge and the region causing the second discharge can be isolated from each other through this diametrical convex portion 19. Consequently, the arcs 20 resulting from the first and second discharges can be prevented from integration. Thus, the number of discharge portions can be prevented from reduction, whereby discharge resistance can be prevented from reduction. Therefore, the ability of the crusher can be reliably improved.

(Third Embodiment)

An electrode for a crusher according to a third embodiment of the present invention is described with reference to FIG. 8.

Figure 8:
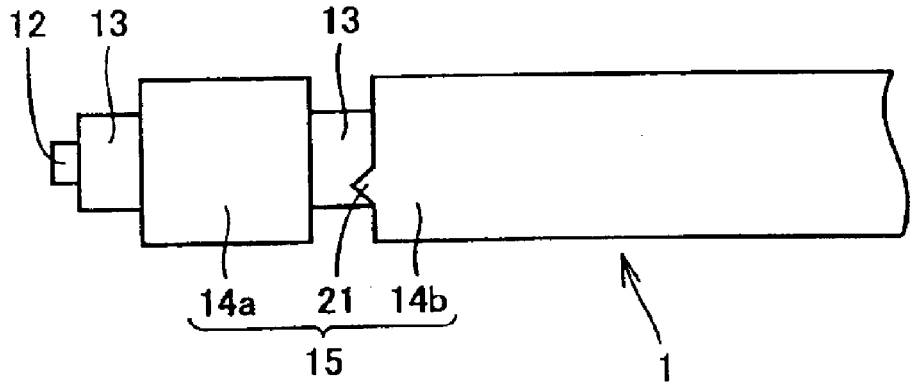
FIG. 8 is a partially enlarged model diagram showing an electrode for a crusher according to a third embodiment of the present invention.

Referring to FIG. 8, a coaxial electrode 1 serving as the electrode for a crusher basically has a structure similar to that of the coaxial electrode shown in FIGS. 1 to 4, while a convex portion 21 serving as a projection projecting in a direction substantially parallel to the extensional direction of the central axis of a center electrode 12 is formed on a peripheral electrode part 14*b*.

In this case, the convex portion 21 serving as the projection is formed on the peripheral electrode part 14*b* so that the distance between a peripheral electrode part 14*a* and the peripheral electrode part 14*b* can be locally reduced when a current is supplied to the coaxial electrode 1, whereby charges can be concentrated to this convex portion 21. Therefore, a discharge can be preferentially caused on the portion formed with this convex portion 21. Thus, the position of the region causing the discharge can be arbitrarily changed by changing the position of the convex portion 21.

The convex portion 21 may alternatively be formed on the peripheral electrode part 14*a*, or may be formed on both of the peripheral electrode parts 14*a* and 14*b*. Further, such convex portions 21 may be formed on a plurality of portions along the circumferential direction. Further, the convex portion 21 may have a shape other than the illustrated triangular shape so far as the same can locally reduce the distance between the peripheral electrode parts 14*a* and 14*b*.

In addition, a convex portion may be formed on a portion of the peripheral electrode part 14*a* closer to an end (the side exposing the center electrode 12) of the coaxial electrode 1. In this case, the position causing a discharge can be changed between the center electrode 12 and the peripheral electrode part 14*a* by changing the position of this convex portion. Further, a similar effect can be attained also when forming the convex portion on an end of the center electrode 12.

(Fourth Embodiment)

An electrode for a crusher according to a third embodiment of the present invention is described with reference to FIGS. 9 and 10.

Figure 9:
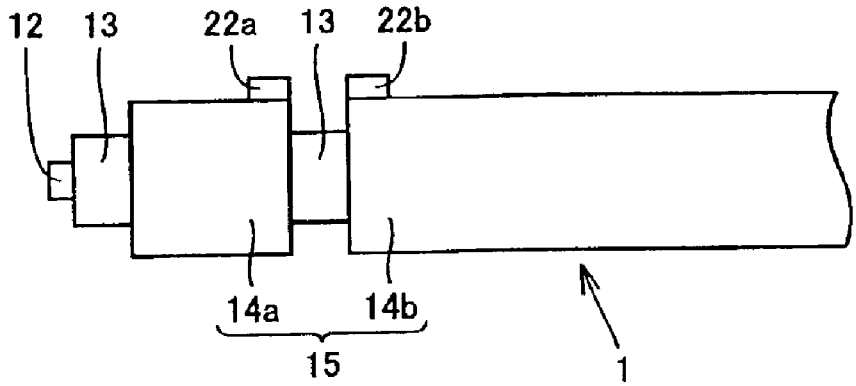
FIG. 9 is a partially enlarged model diagram showing an electrode for a crusher according to a fourth embodiment of the present invention.
Figure 10:
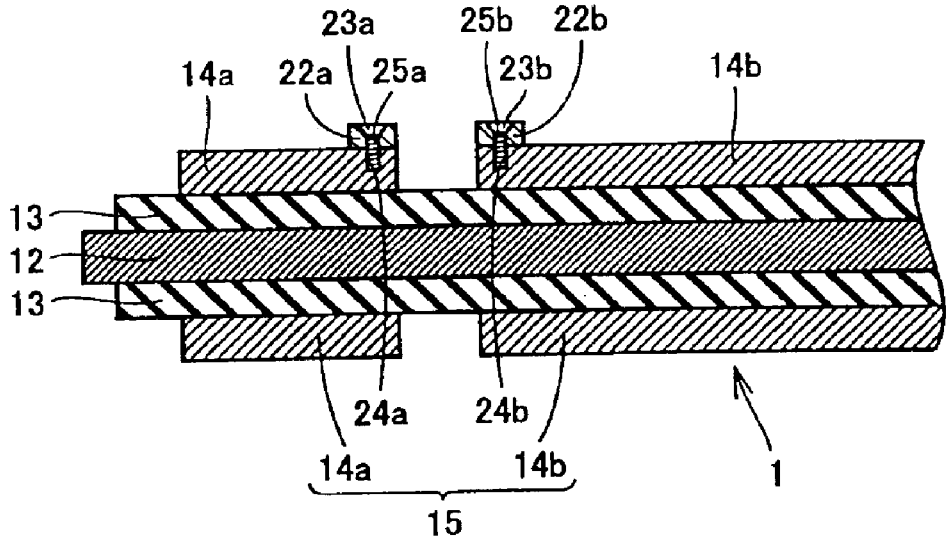
FIG. 10 is a schematic sectional view of the electrode for a crusher shown in FIG. 9.

Referring to FIGS. 9 and 10, a coaxial electrode 1 serving as the electrode for a crusher basically has a structure similar to that of the coaxial electrode shown in FIGS. 1 to 4, while projections 22*a* and 22*b* projecting in the radial direction of the central axis of a center electrode 122 are set on peripheral electrode parts 14*a* and 14*b* respectively.

The projections 22*a* and 22*b* consisting of conductors are formed with threaded holes 25*a* and 25*b* respectively, as shown in FIG. 10. Further, portions of the peripheral electrode parts 14*a* and 14*b* provided with the projections 22*a* and 22*b* are formed with threaded holes 24*a* and 24*b* respectively. A screw 23*a* inserted into the threaded hole 25*a* is inserted into and fixed to the threaded hole 24*a* of the peripheral electrode part 14*a*, thereby fixing the projection 22*a* to the peripheral electrode part 14*a*. A screw 23*b* inserted into the threaded hole 25*b* is inserted into and fixed to the threaded hole 24*b* of the peripheral electrode part 14*b*, thereby fixing the projection 22*b* to the peripheral electrode part 14*b*.

In this case, the shapes of the peripheral electrode parts 14*a* and 14*b* in the radial direction of the central axis can be non-circularized by forming the projections 22*a* and 22*b*, whereby the positions of regions (regions forming arcs) causing discharges can be arbitrarily changed by changing the positions of the projections 22*a* and 22*b*.

Figure 11:
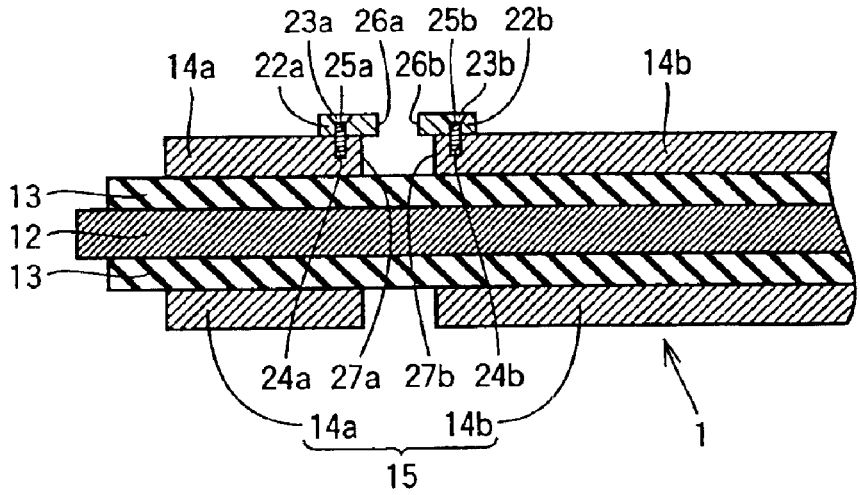
FIG. 11 is a schematic sectional view showing a first modification of the electrode for a crusher shown in FIGS. 9 and 10.

A first modification of the electrode for a crusher shown in FIGS. 9 and 10 is described with reference to FIG. 11. FIG. 11 corresponds to FIG. 10.

Referring to FIG. 11, a coaxial electrode 1 serving as the electrode for a crusher basically has a structure similar to that of the coaxial electrode 1 shown in FIGS. 9 and 10. However, ends 26*a* and 26*b* of projections 22*a* and 22*b* set on peripheral electrode parts 14*a* and 14*b* are set to project beyond side walls 27*a* and 27*b* of the peripheral electrode parts 14*a* and 14*b* respectively (i.e., so that the distance between the side walls of the ends 26*a* and 26*b* of the projections 22*a* and 22*b* is smaller than the distance between the side walls 27*a* and 27*b* of the peripheral electrode parts 14*a* and 14*b*).

According to this structure, the effect according to the coaxial electrode shown in FIG. 8 can also be simultaneously attained in addition to the effect according to the coaxial electrode shown in FIGS. 9 and 10.

Figure 12:
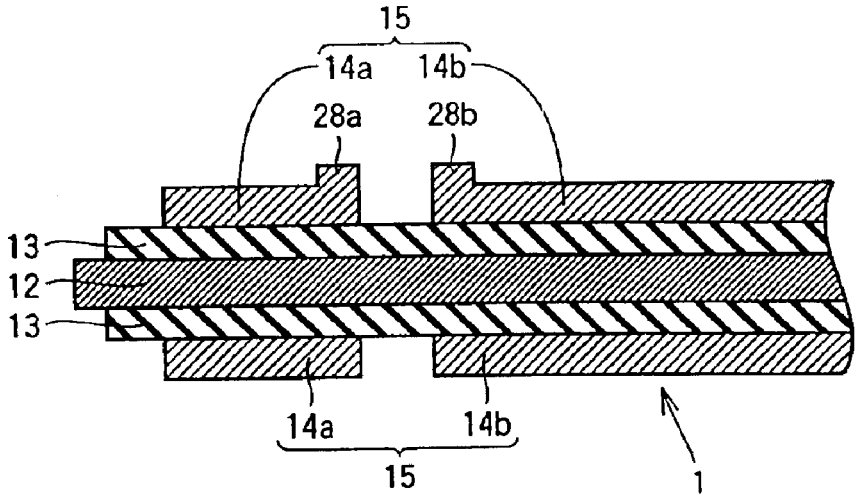
FIG. 12 is a schematic sectional view showing a second modification of the electrode for a crusher shown in FIGS. 9 and 10.

A second modification of the electrode for a crusher shown in FIGS. 9 and 10 is described with reference to FIG. 12. FIG. 12 corresponds to FIG. 10.

Referring to FIG. 12, a coaxial electrode 1 serving as the electrode for a crusher basically has a structure similar to that of the coaxial electrode 1 shown in FIGS. 9 and 10. However, projections 28*a* and 28*b* are integrally molded with peripheral electrode parts 14*a* and 14*b* respectively. In this case, an effect similar to that of the coaxial electrode shown in FIGS. 9 and 10 can be attained.

Figure 13:
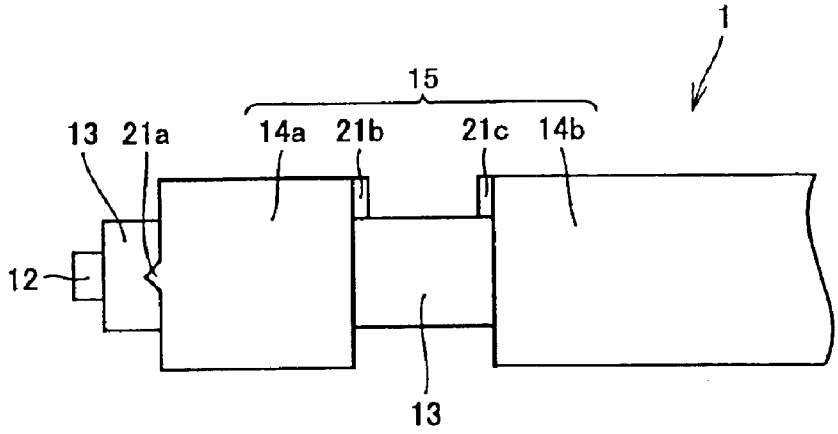
FIG. 13 is a partially enlarged model diagram showing a third modification of the electrode for a crusher shown in FIGS. 9 and 10.

A third modification of the electrode for a crusher shown in FIGS. 9 and 10 is described with reference to FIG. 13. FIG. 13 corresponds to FIG. 9.

Referring to FIG. 13, a coaxial electrode 1 serving as the electrode for a crusher basically has a structure similar to that of the coaxial electrode 1 shown in FIGS. 9 and 10. In the coaxial electrode 1 shown in FIG. 13, however, convex portions 21*a* to 21*c* are formed on both ends of a peripheral electrode part 14*a* and an end of a peripheral electrode part 14*b* to project in a direction substantially parallel to the extensional direction of the central axis of a center electrode 12. The convex portions 21*a* to 21*c* are made of materials similar to those forming the peripheral electrode parts 14*a* and 14*b* respectively. The convex portions 21*b* and 21*c* are formed on positions different from the position of the convex part 21*a* in the circumferential direction of the central axis of the center electrode 12. When a current is supplied to the coaxial electrode, therefore, a discharge (first discharge) between the center electrode 12 and the peripheral electrode part 14*a* is caused on the region between the center electrode 12 and the convex portion 21*a*. On the other hand, a discharge (second discharge) between the peripheral electrode part 14*a* and the peripheral electrode part 14*b* is caused on the region between the convex portions 21*b* and 21*c*. Therefore, it follows that the first discharge and the second discharge are caused on different regions in the circumferential direction of the central axis.

Thus, an arc resulting from the first discharge and an arc resulting from the second discharge can be prevented from connection. Therefore, energy utilized for crushing can be prevented from reduction resulting from connection of the arcs in the first and second discharges.

(Fifth Embodiment)

An electrode for a crusher according to a fifth embodiment of the present invention is described with reference to FIGS. 14 and 15.

Figure 14:
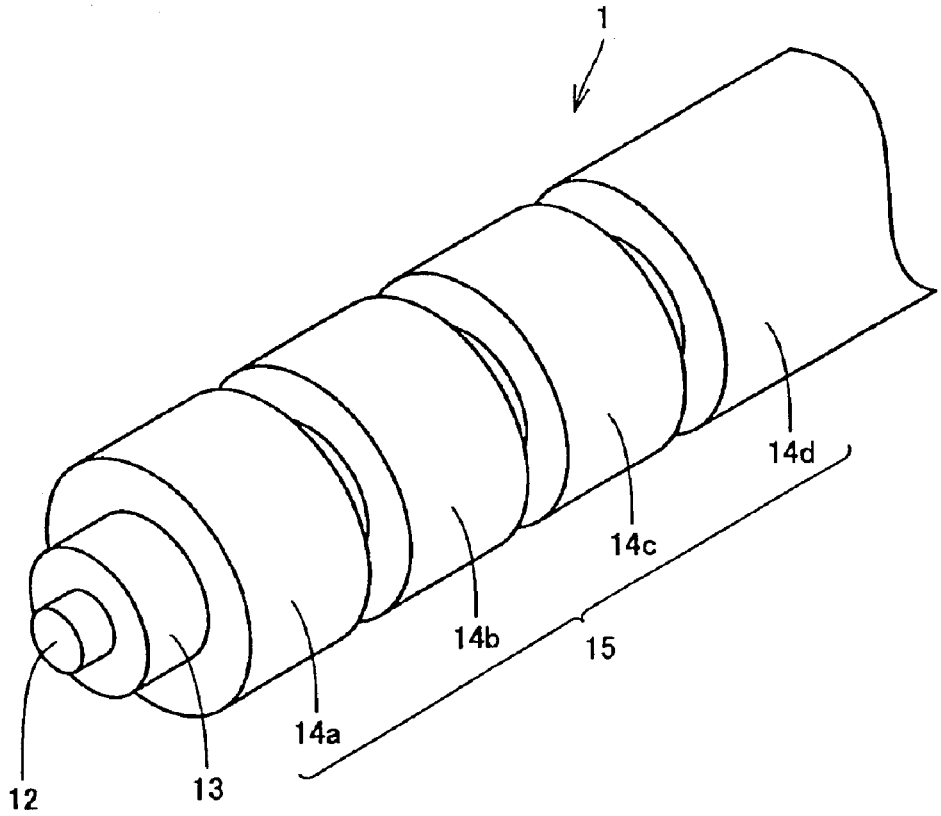
FIG. 14 is a schematic perspective view showing an electrode for a crusher according to a fifth embodiment of the present invention.
Figure 15:
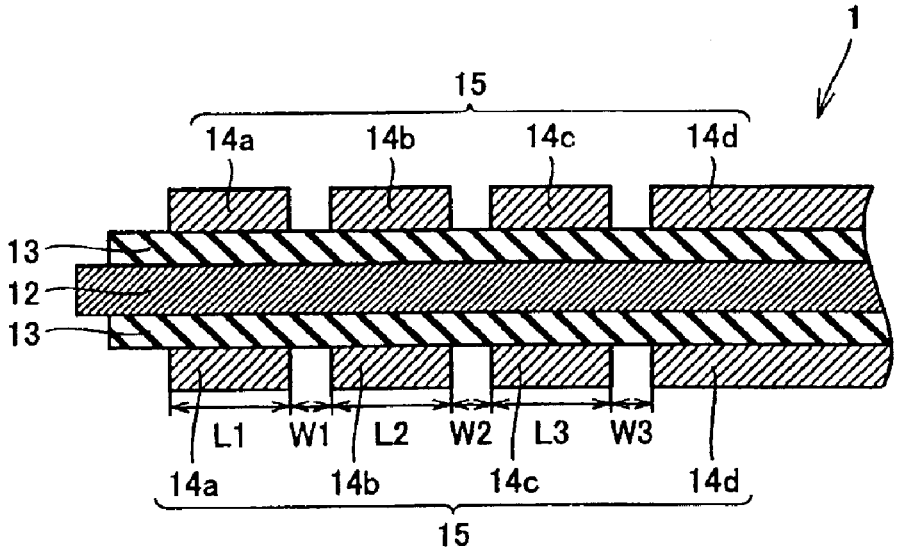
FIG. 15 is a schematic sectional view of the electrode for a crusher shown in FIG. 14.

Referring to FIGS. 14 and 15, a coaxial electrode 1 which is the electrode for a crusher basically has a structure similar to that of the coaxial electrode shown in FIGS. 1 to 4. In the coaxial electrode 1 shown in FIGS. 14 and 15, however, a peripheral electrode 15 includes four peripheral electrode parts 14*a* to 14*d*. The peripheral electrode parts 14*a* to 14*d* are arranged at spaces from each other respectively. It is assumed that L1 to L3 represent the widths of the peripheral electrodes 14*a* to 14*c* in a central axis direction respectively. It is also assumed that the space between the peripheral electrodes 14*a* and 14*b* is at a distance W1, the space between the peripheral electrodes 14*b* and 14*c* is at a distance W2 and the space between the peripheral electrodes 14*c* and 14*d* is at a distance W3. In this case, an effect similar to that of the coaxial electrode shown in FIGS. 1 to 4 can be attained, while discharges can be caused on four portions, i.e., between an end of a center electrode 12 and the peripheral electrode part 14*a*, between the peripheral electrode part 14*a* and the peripheral electrode part 14*b*, between the peripheral electrode part 14*b* and the peripheral electrode part 14*c* and between the peripheral electrode part 14*c* and the peripheral electrode part 14*d*. Therefore, discharge resistance can be further improved, whereby energy emitted by discharges can be further increased. Consequently, the ability of the crusher can be further improved.

A modification of the electrode for a crusher according to the fifth embodiment is described with reference to FIG. 16.

Figure 16:
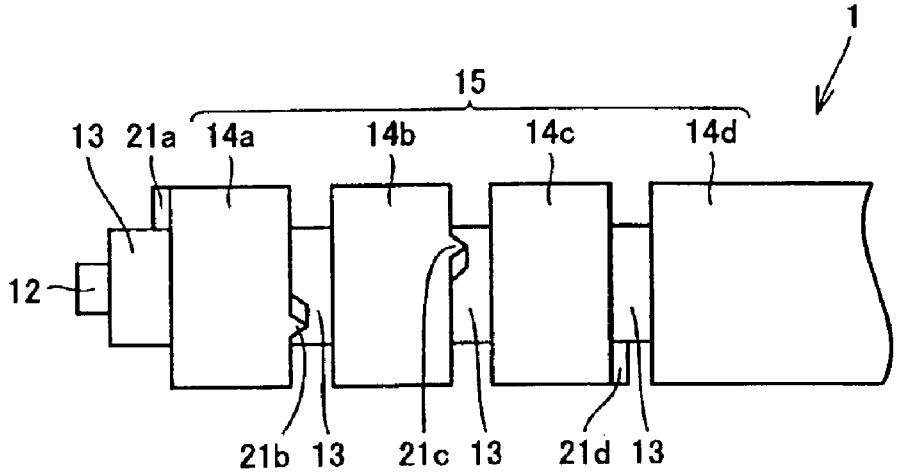
FIG. 16 is a model diagram showing a modification of the electrode for a crusher according to the fifth embodiment shown in FIGS. 14 and 15.

Referring to FIG. 16, a coaxial electrode 1 serving as the electrode for a crusher basically has a structure similar to that of the coaxial electrode 1 shown in FIGS. 14 and 15. In the coaxial electrode 1 shown in FIG. 16, however, convex portions 21*a* to 21*d* are formed on the respective ones of peripheral electrode parts 14*a* to 14*c*. The convex portions 21*a* to 21*d* are formed to project in a direction substantially parallel to the extensional direction of the central axis of a center electrode 12. The convex portions 21*a* to 21*d* are formed on positions different from each other in the circumferential direction of the central axis of the center electrode 12.

A discharge (first discharge) between the forward end of the center electrode 12 and the peripheral electrode part 14*a* is caused on the region between the convex portion 21*a* and the center electrode 12. A discharge (second discharge) between the peripheral electrode part 14*a* and the peripheral electrode part 14*b* is caused on the region between the convex portion 21*b* and the peripheral electrode 14*b*. A discharge (third discharge) between the peripheral electrode part 14*b* and the peripheral electrode part 14*c* is caused on the region between the convex portion 21*c* and the peripheral electrode 14*c*. A discharge (fourth discharge) between the peripheral electrode part 14*c* and a peripheral electrode part 14*d* is caused on the region between the convex portion 21*d* and the peripheral electrode 14*d*.

Thus, the convex portions 21*a* to 21*d* serving as projections are so formed that charges can be concentrated to the convex portions 21*a* to 21*d*, whereby the first to fourth discharges can be caused in the vicinity of the portions formed with the convex portions 21*a* to 21*d* respectively. Thus, the positions causing the first to fourth discharges can be arbitrarily changed by changing the positions of the convex portions 21*a* to 21*d*.

When the convex portions 21*a* to 21*d* are arranged as shown in FIG. 16, it follows that the first to fourth discharges caused in the coaxial electrode are formed on positions different from each other in the circumferential direction of the central axis of the center electrode 12. Therefore, arcs of adjacent discharges can be reliably prevented from connection.

While the convex portions 21*a* to 21*d* are formed to project in the direction substantially parallel to the extensional direction of the central axis of the center electrode 12 in FIG. 16, the convex portions 21*a* to 21*d* may alternatively be formed to project in the radial direction of the central axis as shown in FIGS. 9 to 12. Also in this case, an effect similar to that of the coaxial electrode shown in FIG. 16 can be attained.

The widths (the lengths in the extensional direction of the central axis of the center electrode 12) of the peripheral electrodes 14*a* to 14*d* in the first to fifth embodiments of the present invention are preferably at least 10 mm. In this case, the arcs formed following the discharges can grow to sufficient sizes with no restriction by the widths of the peripheral electrodes 14*a* to 14*d*. Therefore, the energy utilized for crushing can be increased.

The widths of the peripheral electrodes 14*a* to 14*d* in the first to fifth embodiments of the present invention may be at least 20 mm. Thus, also when two adjacent discharges are caused on positions close to each other in the circumferential direction of the central axis of the center electrode 12, arcs resulting from the two discharges can be reliably prevented from connection.

In order to confirm the effects of the present invention, the inventor has made a discharge experiment with the electrode for a crusher according to the present invention. This experiment is described with reference to FIGS. 17 and 18.

Figure 17:
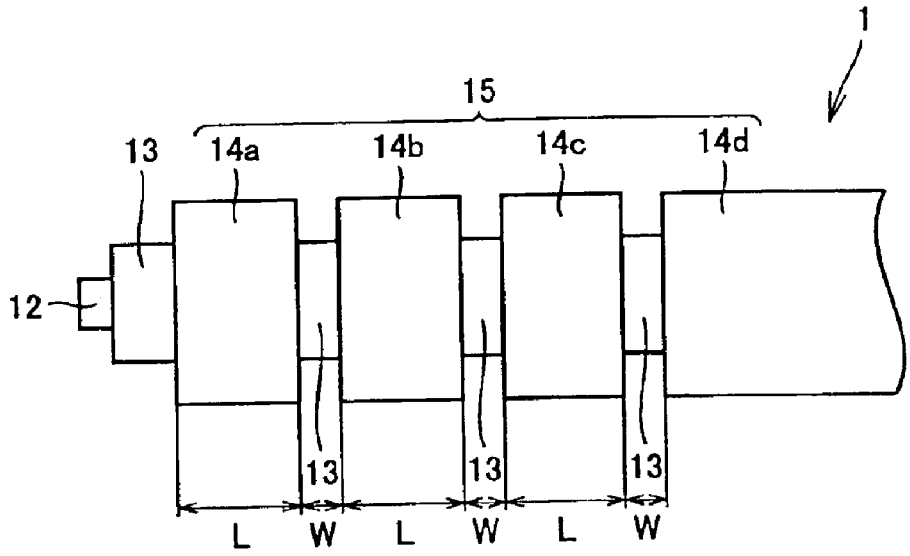
FIG. 17 is a model diagram showing an electrode for a crusher employed for an experiment.

Referring to FIG. 17, a coaxial electrode 1 serving as the electrode for a crusher prepared by the inventor basically has a structure similar to that of the electrode for a crusher according to the fifth embodiment of the present invention. In other words, the coaxial electrode 1 comprises a center electrode 12, an insulator 13 arranged on the outer peripheral surface of this center electrode 12 and peripheral electrode parts 14*a* to 14*d* arranged on the outer peripheral surface of this insulator 13. The center electrode 12 extends along a central axis, and consists of copper. The diameter of the center electrode 12 is 20 mm. The insulator 13 consists of FRP (fiber reinforced plastics), and the thickness thereof is 10 mm. The peripheral electrode parts 14*a* to 14*d* forming a peripheral electrode 15 consist of copper, and the thickness thereof is 5 mm. Therefore, the outer diameter of the coaxial electrode 1 is 50 mm. The width L of the peripheral electrode parts 14*a* to 14*c* is 27 mm, and the distance W between the peripheral electrodes 14*a* to 14*d* was set to 10 mm. A capacitor having electrostatic capacitance of 2 mF was charged up to 15 kV, and thereafter this capacitor and the aforementioned coaxial electrode 1 were connected with each other through a cable having circuit impedance of 3 $\mu$H, thereby causing discharges in the coaxial electrode 1.

Figure 18:
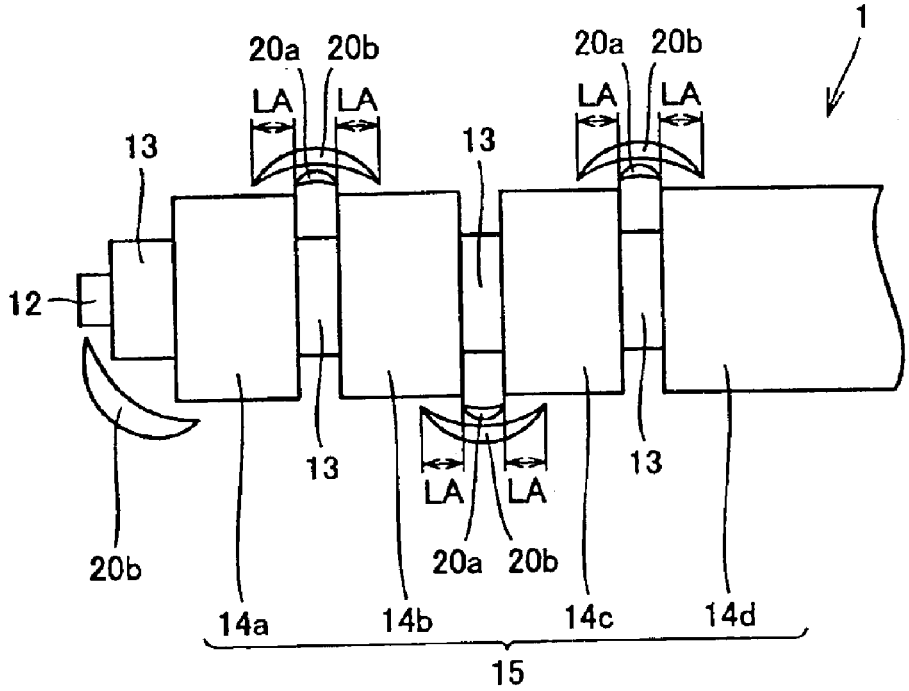
FIG. 18 is a model diagram showing a state causing discharges in the experiment.
Figure 19:
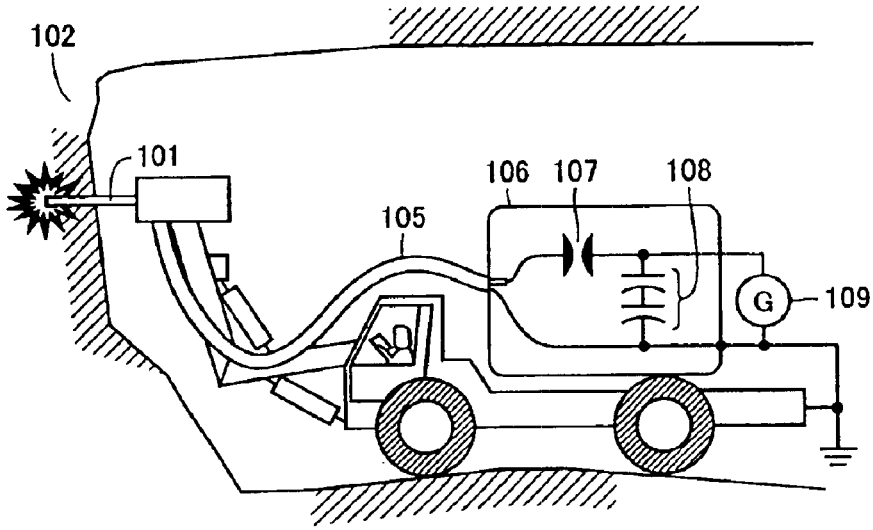
FIG.19 PRIOR ART
FIG. 19 is a model diagram showing a conventional crusher.
Figure 20:
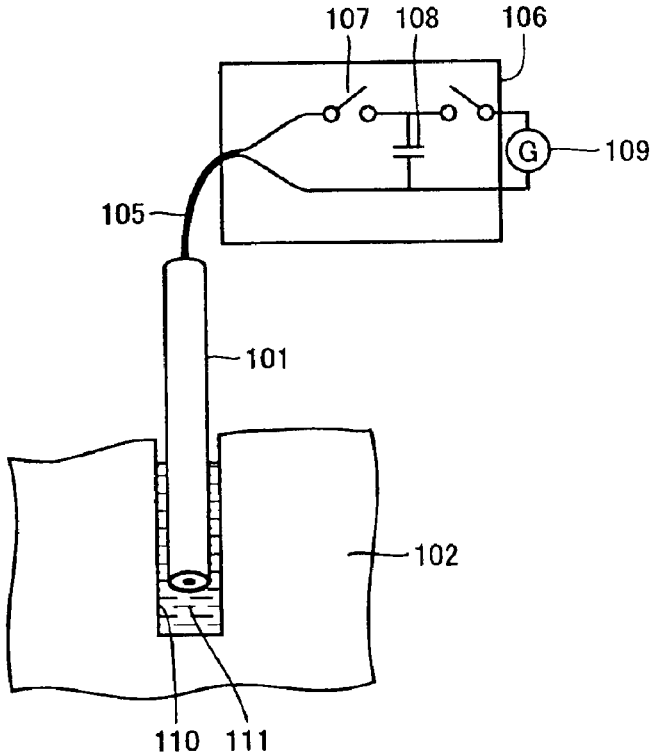
FIG.20 PRIOR ART
FIG. 20 is a model diagram showing the basic structure of the crusher shown in FIG. 19.
Figure 21:
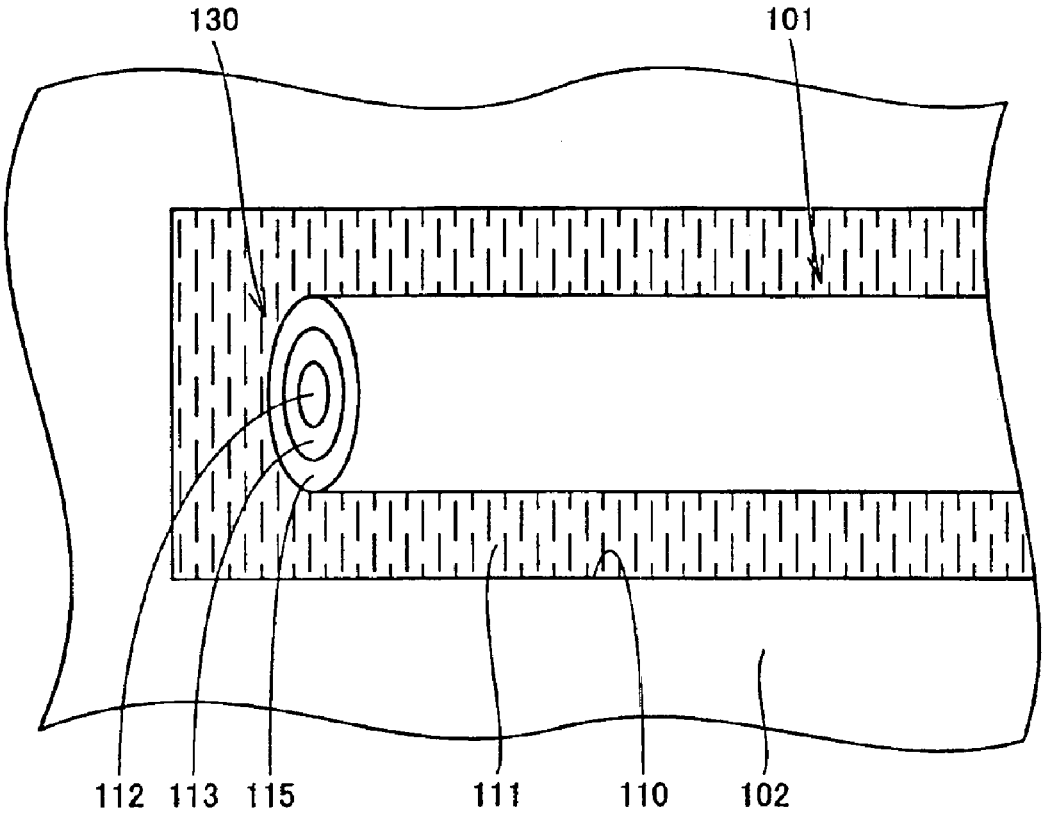
FIG.21 PRIOR ART
FIG. 21 is a partially enlarged model diagram showing the forward end of the electrode shown in FIG. 20.

As shown in FIG. 18, arcs 20*a* having relatively small sizes are caused between the peripheral electrodes 14*a* to 14*d* immediately after starting the discharges. The sizes of the arcs are increased with time, to finally form arcs 20*b* having relatively large sizes. In the sufficiently enlarged (grown) arcs 20*b*, it was observed that ends of the arcs 20*b* in the direction along the central axis of the center electrode 12 inwardly extended by a length LA from the ends of the peripheral electrode parts 14*a* to 14*d*. The value of the length LA was about 10 mm.

Also when the charging voltage for the capacitor was varied in the range of 6 to 15 kV, the situation of formation of the arcs remained substantially unchanged and the value of the length LA was substantially 10 mm. Also when the distance W between the peripheral electrodes 14*a* to 14*d* was varied, this length LA remained substantially unchanged.

Thus, it is understood that sufficiently grown large arcs 20*b* can be formed in discharges when the width L of the peripheral electrodes 14*a* to 14*d* is at least 10 mm (when the width L of the peripheral electrodes 14*a* to 14*d* is set to less than 10 mm, the arcs cannot be sufficiently grown and hence it is conceivable that the amount of energy utilized for crushing is consequently reduced. Depending on the positions of adjacent arcs, there is a possibility of such a phenomenon that the adjacent arcs (for example, the arc generated between the peripheral electrodes 14*a* and 14*b* and the arc generated between the peripheral electrodes 14*b* and 14*c*) are connected with each other. Also in this case, it is conceivable that the amount of energy utilized for crushing is reduced).

In the coaxial electrode 1, convex portions 21*a* to 21*d* may be formed on the peripheral electrodes 14*a* to 14*d* on positions different from each other in the circumferential direction of the central axis of the center electrode 12, as shown in FIG. 16. In this case, arcs can be generated on different positions in the circumferential direction of the central axis of the center electrode 12. Also when the width L of the peripheral electrodes 14*a* to 14*c* is about 10 mm, therefore, the adjacent arcs 20*b* can be reliably prevented from connection.

When the width L of the peripheral electrodes 14*a* to 14*d* is set to a length of at least 20 mm as in the coaxial electrode 1 employed for the experiment, the arcs 20*b* can be reliably prevented from connection even if the adjacent arcs 20*b* are formed on positions close to each other in the circumferential direction of the central axis of the center electrode 12.

The embodiments and Example disclosed this time must be considered as illustrative and not restrictive in al points. The scope of the present invention is shown not by the aforementioned embodiments and Example but by the scope of claim for patent, and it is intended that all modifications in the meaning and range equivalent to the scope of claim for patent are included.

According to the present invention, as hereinabove described, discharges can be caused on a plurality of positions with a single electrode for a crusher, whereby energy utilized for crushing can be increased.

INDUSTRIAL AVAILABILITY

As hereinabove described, the electrode for a crusher according to the present invention can be applied to crushing of rock or bedrock, crushing of an artificial structure of concrete, or the like.

What is claimed is:

1. An electrode for a crusher, comprising:

a central conductor extending along a central axis and having an outer peripheral surface;

an insulating member arranged on the outer peripheral surface of said central conductor; and a peripheral conductor arranged to enclose said insulating member, wherein said peripheral conductor includes:

a first conductor, and a second conductor arranged at a space from said first conductor in the extensional direction of said central axis; and wherein said central conductor, said first conductor and said second conductor are electrically isolated from one another.

2. The electrode for a crusher according to claim 1, wherein said central conductor includes a discharge end, said first conductor is arranged sufficiently close to said discharge end in the extensional direction of said central axis to cause a discharge therebetween, said first conductor includes first and second end portions having relatively small diameters and a portion having a relatively large diameter between said first and second end portions.

3. The electrode for a crusher according to claim 1, wherein a projection is formed on at least either one of said first and second conductors.

4. The electrode for a crusher according to claim 3, wherein said projection projects in a direction substantially parallel to the extensional direction of said central axis.

5. The electrode for a crusher according to claim 3, wherein said projection projects in the radial direction of said central axis.

6. The electrode for a crusher according to claim 3, wherein said projection includes:

a first projection formed on either one of said first and second conductors, and a second projection formed on a position different from the position of said first projection in the circumferential direction of said central axis on at least either one of said first and second conductors.

7. The electrode for a crusher according to claim 1, wherein the length of at least either one of said first and second conductors is at least 10 mm in the extensional direction of said central axis.

8. The electrode for a crusher according to claim 1, wherein said peripheral conductor includes at least one additional conductor arranged at a space from said second conductor in the extensional direction of said central axis.

9. The electrode for a crusher according to claim 8, wherein a projection is formed on at least one conductor selected from a group consisting of said first conductor, said second conductor and said additional conductor.

10. The electrode for a crusher according to claim 9, wherein said projection projects in a direction substantially parallel to the extensional direction of said central axis.

11. The electrode for a crusher according to claim 9, wherein said projection projects in the radial direction of said central axis.

12. The electrode for a crusher according to claim 9, wherein said projection includes:

a first projection formed on one conductor selected from the group consisting of said first conductor, the second conductor and the additional conductor, and a second projection formed on a position different from the position of said first projection in the circumferential direction of said central axis in at least one conductor selected from the group consisting of said first conductor, the second conductor and the additional conductor.

13. The electrode for a crusher according to claim 8, wherein the length of at least one conductor selected from a group consisting of said first conductor, the second conductor and the additional conductor is at least 10 mm in the extensional direction of said central axis.

14. The electrode for a crusher according to claim 1, wherein said central conductor includes a stranded conductor, and said insulating member contains a flexible material.

15. A crusher comprising the electrode for a crusher according to claim 1.

* * * * *